US012241366B2

(12) United States Patent
Kumar et al.

(10) Patent No.: US 12,241,366 B2
(45) Date of Patent: Mar. 4, 2025

(54) DETERMINING PARAMETERS FOR A WELLBORE OPERATION BASED ON RESONANCE SPEEDS OF DRILLING EQUIPMENT

(71) Applicant: Landmark Graphics Corporation, Houston, TX (US)

(72) Inventors: Swaminathan Kiran Kumar, Bangalore (IN); Robello Samuel, Cypress, TX (US)

(73) Assignee: Landmark Graphics Corporation, Houston, TX (US)

( * ) Notice: Subject to any disclaimer, the term of this patent is extended or adjusted under 35 U.S.C. 154(b) by 52 days.

(21) Appl. No.: 17/553,738

(22) Filed: Dec. 16, 2021

(65) Prior Publication Data

US 2023/0193749 A1 Jun. 22, 2023

(51) Int. Cl.
*E21B 47/12* (2012.01)
*E21B 45/00* (2006.01)

(52) U.S. Cl.
CPC ..... *E21B 47/138* (2020.05); *E21B 45/00* (2013.01)

(58) Field of Classification Search
CPC ..... E21B 47/138; E21B 45/00
See application file for complete search history.

(56) References Cited

U.S. PATENT DOCUMENTS 8,417,456 B2 4/2013 Mauldin et al.
2011/0077924 A1* 3/2011 Ertas ..... E21B 7/00 703/2
2011/0186353 A1* 8/2011 Turner ..... E21B 44/00 703/2
2011/0214878 A1 9/2011 Bailey et al.
2011/0245980 A1 10/2011 Nessjoen et al.
2012/0123757 A1 5/2012 Ertas et al.
(Continued)

FOREIGN PATENT DOCUMENTS

CA 2987662 C * 6/2018 ..... E21B 44/02
CN 102575516 12/2014
WO 2010138718 A1 12/2010

OTHER PUBLICATIONS

R. Samuel and A. Mirani, "Vibration Modeling and Analysis Under Backreaming Condition", SPE Annual Technical Conference and Exhibition held in Houston, Texas, USA, Sep. 28-30, 2015 (Year: 2015).*

(Continued)

*Primary Examiner* — Douglas Kay
(74) *Attorney, Agent, or Firm* — Kilpatrick Townsend & Stockton LLP

(57) ABSTRACT

Drilling parameters for a wellbore operation can be determined based on resonance speeds. For example, a system can receive real-time data for a drilling operation that is concurrently occurring with receiving the real-time data. The system can determine, for a drilling depth, a rotations-per-minute (RPM) value corresponding to a resonance speed based on a weight-on-bit (WOB) value and the real-time data. The system can generate a plot of the WOB value and the RPM value corresponding to the resonance speed. The system can determine drilling parameters for the drilling operation based on the plot. The drilling parameters can exclude, for the WOB value, the RPM value corresponding to the resonance speed.

20 Claims, 7 Drawing Sheets

(56) References Cited

U.S. PATENT DOCUMENTS

| | | | | |
|---|---|---|---|---|
| 2020/0173269 | A1* | 6/2020 | Madasu | E21B 7/04 |
| 2020/0190957 | A1* | 6/2020 | Madasu | G06N 20/00 |
| 2020/0302353 | A1* | 9/2020 | Tang | E21B 44/00 |
| 2020/0355059 | A1* | 11/2020 | Zhang | E21B 41/00 |

OTHER PUBLICATIONS

A. A. Mirani and R. Samuel, "Discrete Vibration Stability Analysis With Hydromechanical Specific Energy", Journal of Energy Resources Technology, Mar. 2018, vol. 140 (Year: 2018).*

P. Bimastianto and et al, "Digital Twin Implementation on Current Development Drilling, Benefits and Way Forward", the Abu Dhabi International Petroleum Exhibition & Conference held in Abu Dhabi, UAE, Nov. 9-12, 2020 (Year: 2020).*

J. R. Jain and et al, "High-Frequency Torsional Dynamics of Drilling Systems: An Analysis of the Bit-System Interaction", 2014 IADC/SPE Drilling Conference and Exhibition held in Fort Worth, Texas, USA, Mar. 4-6, 2014 (Year: 2014).*

Dunayevsky, V. A., A. Judzis, and F. Abbassian. "Use of Dynamic Drillstring Simulator for RPM and Bottomhole Assembly Optimisation." In Offshore Technology Conference, pp. OTC-5902. OTC, 1989 (Year: 1989).*

Zarate Losoya, Enrique. "Real-time Control and Vibrations Analysis of a Completely Automated Miniaturized Rig." PhD diss., 2016 (Year: 2016).*

Frenzel et al., "Case Histories of Real Time Drilling Optimization Combining Drill String Modeling, Surface Measurements and Down-Hole Measurements", Paper presented at the IADC/SPE Drilling Conference and Exhibition, Fort Worth, Texas, doi: https://doi.org/10.2118/167960-MS, Mar. 2014.

International Search Report and Written Opinion, PCT/2021/063924, Sep. 7, 2022, 11 pages.

* cited by examiner

DETERMINING PARAMETERS FOR A WELLBORE OPERATION BASED ON RESONANCE SPEEDS OF DRILLING EQUIPMENT

TECHNICAL FIELD

The present disclosure relates generally to wellbore operations and, more particularly (although not necessarily exclusively), to determining parameters for a wellbore operation based on resonance speeds of drilling equipment.

BACKGROUND

The hydrocarbon extraction industry makes use of wellbore drilling to explore and recover natural resources such as water, oil, and gas. During wellbore drilling, drilling fluid is pumped into the well to enable hydrocarbons to be released. The hydrocarbons, along with the drilling fluid, flow up the wellbore through a wellbore annulus to be extracted. Drilling equipment may be affected by vibrations during a drilling operation, which may cause the drilling equipment to malfunction or otherwise perform sub-optimally.

DETAILED DESCRIPTION

Figure 1:
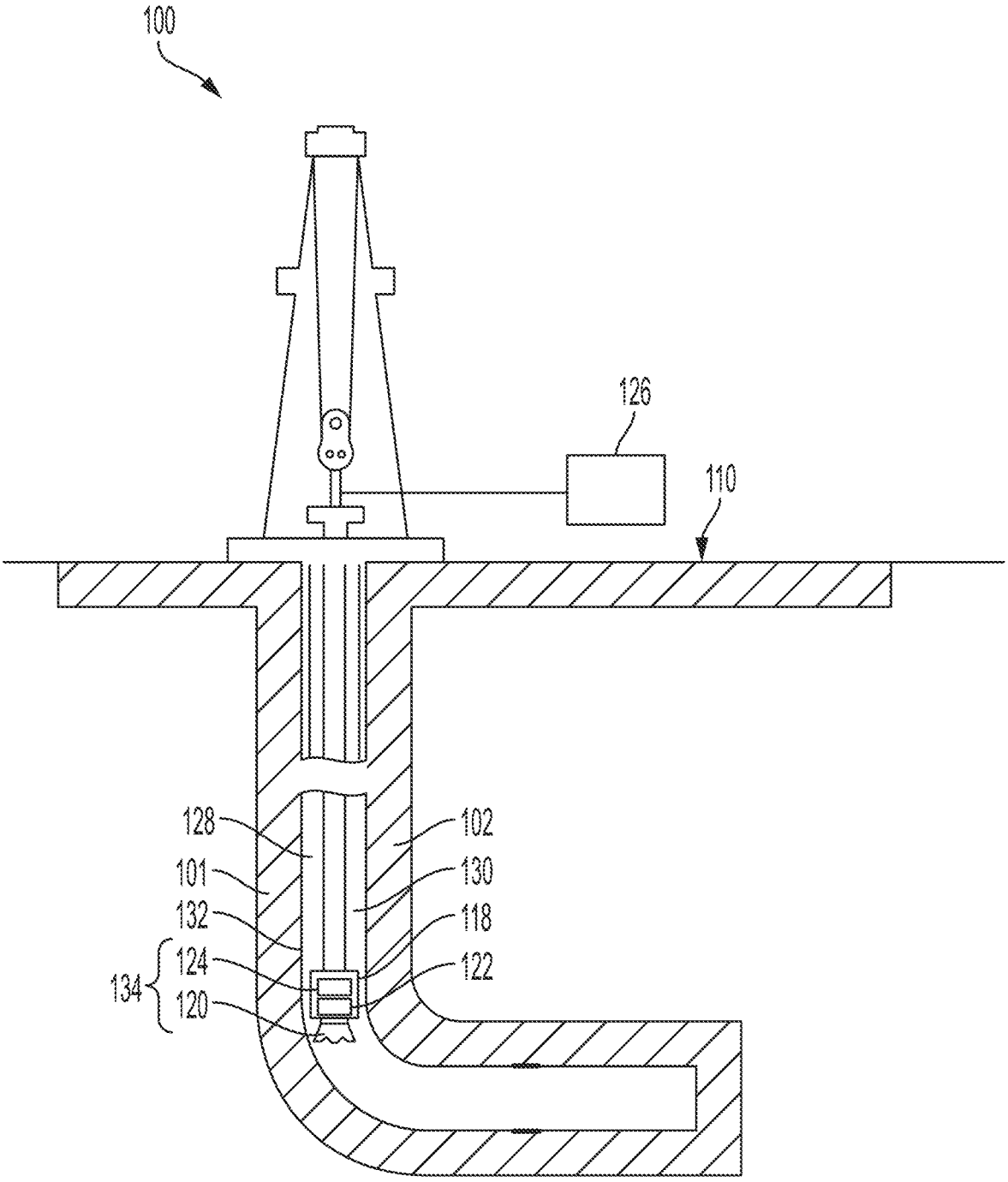
FIG. 1 is a schematic of a drilling rig and a system for drilling a wellbore according to one example of the present disclosure.

Certain aspects and examples of the present disclosure relate to determining operating parameters for a wellbore operation while taking resonance into account. A mechanical system can be under mechanical resonance, or at a resonance speed, when a frequency of operation of equipment, such as drilling machinery, equals a natural frequency of the system. The system undergoing resonance can be displaced by large operational amplitudes, which often results in large mechanical stresses in a body of the mechanical system. Thus, avoiding resonance may be beneficial when dynamic machinery is being operated, such as during a drilling operation when a drill pipe and a drill bit of drill machinery are subjected to mechanical stresses. During the drilling process, the drill string is affected largely by two types of vibrations, the lateral vibration of the string, and the torsional vibration of the string. Thus, the drill machinery has the possibility of undergoing lateral forward whirl vibration. If the mechanical stresses on the drill machinery are sufficiently large, it may cause dramatic failures, which might lead to economic losses and an indefinite delay in completion of the drilling process.

By using a system according to some examples, resonance can be taken into account prior to a drilling operation, which can reduce a likelihood of operating at a resonance condition. Avoiding operating at a resonance condition may result in less wear and tear on the system from the high stresses and displacements imposed on the system. Additionally, using the system to avoid operating at a resonance condition can lead to lower operation costs caused when a drilling system malfunctions from going into resonance.

Weight-on-bit (WOB) and rotations-per-minute (RPM) are examples of drilling parameters that can affect whether the drilling system is subjected to resonance or not. The RPM values at each WOB for which stress and displacement values peak can be considered to be critical speeds. Critical speeds are also called resonance speeds, where the stress and displacement in a mechanical system becomes significantly large compared to the values of stress and displacement in the vicinity of the noted critical speeds.

In some examples, a plot can be generated that illustrates operating conditions in which the resonance speeds occur during the drilling operation. For a particular WOB and RPM of the drilling operation, a particular RPM-WOB point can be shown on the plot. A set of points can be identified as lying in a particular region in the plot, and operating in the particular region can render the drilling system devoid of vibration. The region can be chosen as a suitable region of operation based on wellbore parameters and other characteristics of the drilling operation. Constraints may be added in the form of curves to the WOB-RPM plot, which can reduce a span of the suitable region of operation. The constraints may pertain to a maximum mechanical specific energy (MSE), a maximum hydro-mechanical specific energy (HMSE), a bit-wear rate of penetration (ROP) line, etc.

An additional set of curves can be added to the plot that indicates the values of RPM-WOB points that are to be avoided to prevent resonance from inducing in the system. A plot can generated for each depth of the drilling operation. Less prominent resonance points, which can be an RPM-WOB pair that causes resonance but is not prominent, may be removed from the chart to improve readability of the chart. The less prominent resonance points can correspond to points that display low levels of induced stress and displacement compared to the stress and displacement at other resonance points. The plot can be a guideline during the drilling operation that can allow an operator to identify values of the operating parameters that can cause the system to be at a resonance speed. As a result, operating parameters can be selected that avoid the resonance speeds. The system may be able to automatically implement the selected operating parameters determined from the plot by sending the selected operating parameters as setpoints for the parameters to the drilling system.

Illustrative examples are given to introduce the reader to the general subject matter discussed herein and are not intended to limit the scope of the disclosed concepts. The following sections describe various additional features and examples with reference to the drawings in which like numerals indicate like elements, and directional descriptions are used to describe the illustrative aspects, but, like the illustrative aspects, should not be used to limit the present disclosure.

FIG. 1 is a schematic diagram of a drilling rig 100 for drilling a wellbore 102 into a subterranean formation 101 according to one example of the present disclosure. In this example, drilling rig 100 is depicted for a well, such as an oil or gas well, for extracting fluids from a subterranean formation 101. The drilling rig 100 may be used to create a wellbore 102 from a surface 110 of the subterranean formation 101. The drilling rig 100 includes a well tool or downhole tool 118, and a drill bit 120. The downhole tool 118 can be any tool used to gather information about the wellbore 102. For example, the downhole tool 118 can be a tool delivered downhole by wireline, often referred to as wireline formation testing ("WFT"). Alternatively, the downhole tool 118 can be a tool for either measuring-while-drilling or logging-while-drilling. The downhole tool 118 can include a sensor component 122 for determining information about the wellbore 102. Examples of information can include ROP, WOB, standpipe pressure, depth, mud flow in, RPM, torque, equivalent circulation density, or other parameters. The downhole tool 118 can also include a transmitter 124 for transmitting data from the sensor component 122 to the surface 110. The downhole tool 118 can further include the drill bit 120 for drilling the wellbore 102.

The wellbore 102 is shown as being drilled from the surface 110 and through the subterranean formation 101. As the wellbore 102 is drilled, drilling fluid can be pumped through the drill bit 120 and into the wellbore 102 to enhance drilling operations. As the drilling fluid enters into the wellbore, the drilling fluid circulates back toward the surface 110 through a wellbore annulus 128—the area between the drill bit 120 and the wellbore 102. Fractures 104, 106, or 108 may be of natural origin or may be created during drilling operations. For example, fractures in the wellbore may be induced by increasing the pressure of the drilling fluid until the surrounding formation fails in tension and a fracture is induced.

Also included in the schematic diagram is a computing device 126. The computing device 126 can be communicatively coupled to the downhole tool 118 and receive real-time data about the drilling process. The computing device 126 can use the real-time data to determine and implement drilling parameters for the drilling operation. The computing device 126 can select drilling parameters that avoid resonance speeds for the drilling equipment.

Figure 2:
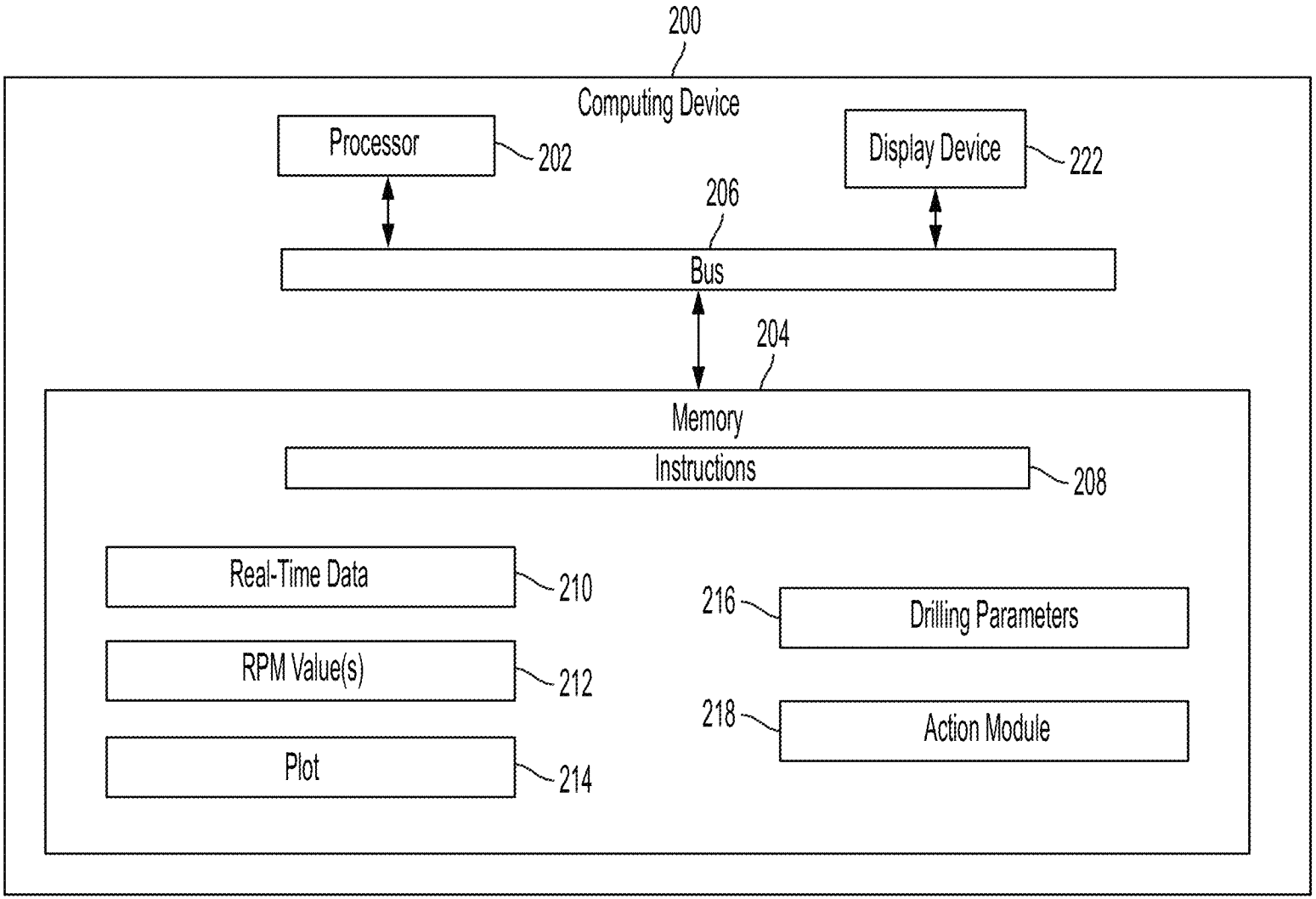
FIG. 2 is a block diagram of a computing device for determining parameters for a wellbore operation based on resonance speeds of drilling equipment according to one example of the present disclosure.

FIG. 2 is a block diagram of a computing device 200 for determining parameters for a wellbore operation based on resonance speeds of drilling equipment according to one example of the present disclosure. While FIG. 2 depicts the computing device 200 as including certain components, other examples may involve more, fewer, or different components than are shown in FIG. 2. In an example, the computing device 200 may be implemented as the computing device 126, as described above with respect to FIG. 1.

As shown, the computing device 200 includes a processor 202 communicatively coupled to a memory 204 by a bus 206. The processor 202 can include one processor or multiple processors. Non-limiting examples of the processor 202 include a Field-Programmable Gate Array (FPGA), an application-specific integrated circuit (ASIC), a microprocessor, or any combination of these. The processor 202 can execute instructions 208 stored in the memory 204 to perform operations. In some examples, the instructions 208 can include processor-specific instructions generated by a compiler or an interpreter from code written in any suitable computer-programming language, such as C, C++, C#, or Java.

The memory 204 can include one memory device or multiple memory devices. The memory 204 can be non-volatile and may include any type of memory device that retains stored information when powered off. Non-limiting examples of the memory 204 include electrically erasable and programmable read-only memory (EEPROM), flash memory, or any other type of non-volatile memory. At least some of the memory device includes a non-transitory computer-readable medium from which the processor 202 can read instructions 208. A non-transitory computer-readable medium can include electronic, optical, magnetic, or other storage devices capable of providing the processor 202 with the instructions 208 or other program code. Non-limiting examples of a non-transitory computer-readable medium include magnetic disk(s), memory chip(s), ROM, random-access memory (RAM), an ASIC, a configured processor, optical storage, or any other medium from which a computer processor can read the instructions 208.

The computing device 200 may receive real-time data 210 for a drilling operation. The drilling operation can be occurring concurrently with the computing device 200 receiving the real-time data 210. Sensor components deployed downhole in a wellbore can send the real-time data 210 to the computing device 200. The real-time data 210 can include wellbore parameters and drilling information. For example, the real-time data 210 can include a wellbore inclination, drilling depth, standpipe pressure, mud flow in, rate of penetration, torque, equivalent circulation density, or any other drilling data. For the drilling depth and a WOB value, the computing device 200 can determine an RPM value 212 that corresponds to a resonance speed. That is, the computing device 200 can determine the RPM value 212 that can cause drilling equipment to experience vibration when used in correlation with the WOB value. The WOB value and the RPM value 212 that corresponds to a resonance speed can be considered a resonance speed point. The computing device 200 can determine an RPM value 212 for each possible WOB value of the drilling equipment. Additionally, each WOB value may be associated with multiple RPM values 212 that correspond to resonance speeds. It may be beneficial to avoid the RPM values 212 that correspond to the resonance speeds to avoid lateral forward whirl.

The computing device 200 can generate a plot 214 of the resonance speed points. One or more curves can be generated on the plot 214 by connecting the resonance speed points. The computing device 200 can also determine a stable region in the plot 214, such as by performing dynamic-stability analysis. The stable region can correspond to combinations of WOB values and RPM values that may help mitigate vibration that might occur during the drilling operation as a result of dynamic instability. The stable region can be bounded by curves corresponding to torsional instability and lateral instability. Bounding the stable region can ensure that RPM values and WOB values that result in backward whirl or torsional stick-slip vibration are avoided during the drilling operation. The curves for the resonance speed points may be within the stable region, but can be considered unstable points. The computing device 200 can also add constraints to the plot 214, which can reduce a size of the stable region. The constraints can include one or more of a maximum mechanical specific energy curve, a maximum hydro-mechanical specific energy curve, a bit-wear rotations-per-minute curve, or a combination thereof.

The computing device 200 may determine that a WOB value is associated with multiple RPM values 212 that correspond to resonance speeds. The computing device 200 can compare stresses and displacements associated with each of the resonance speeds to determine which resonance speed point for the WOB value is associated with a higher stress and displacement. To improve cleanliness and readability of the plot 214, the computing device 200 can remove resonance speed points that are associated with lower stresses and displacements.

The computing device 200 may additionally determine and remove outliers from the plot 214. To identify an outlier, the computing device 200 may use a suitable algorithm, such as a z-scoring model, a proximity-based model, a linear regression model, or a statistical model. The computing device 200 can then remove resonance speed points determined to be outliers.

In some examples, the computing device 200 includes a display device 222. The display device 222 can represent one or more components used to output data. Examples of the display device 222 can include a liquid-crystal display (LCD), a computer monitor, a touch-screen display, etc. The computing device 200 can output the plot 214 to a user interface of the display device 222. An operator may then use the plot 214 to determine drilling parameters 216 for the drilling operation.

The computing device 200 can determine drilling parameters 216 that are to be used for the drilling operation. The drilling parameters 216 can be selected for the drilling depth indicated in the real-time data 210. The drilling parameters 216 can include an operating WOB value and an operating RPM value. The computing device 200 can select a combination of a WOB value and an RPM value that is within the stable region and that is not a resonance speed point on the plot 214.

The computing device 200 can also include an action module 218. The action module 218 can include executable program code for taking one or more actions based on the plot 214. For example, computing device 200 may execute the action module 218 to adjust the drilling operation to use the drilling parameters 216, which can avoid operating at conditions associated with a resonance speed, therefore reducing operating costs resulting from a drilling system malfunctioning from going into resonance. The action module 218 can send the drilling parameters 216 to the drilling system, which can use the drilling parameters 216 as control setpoints during the drilling operation.

Figure 3:
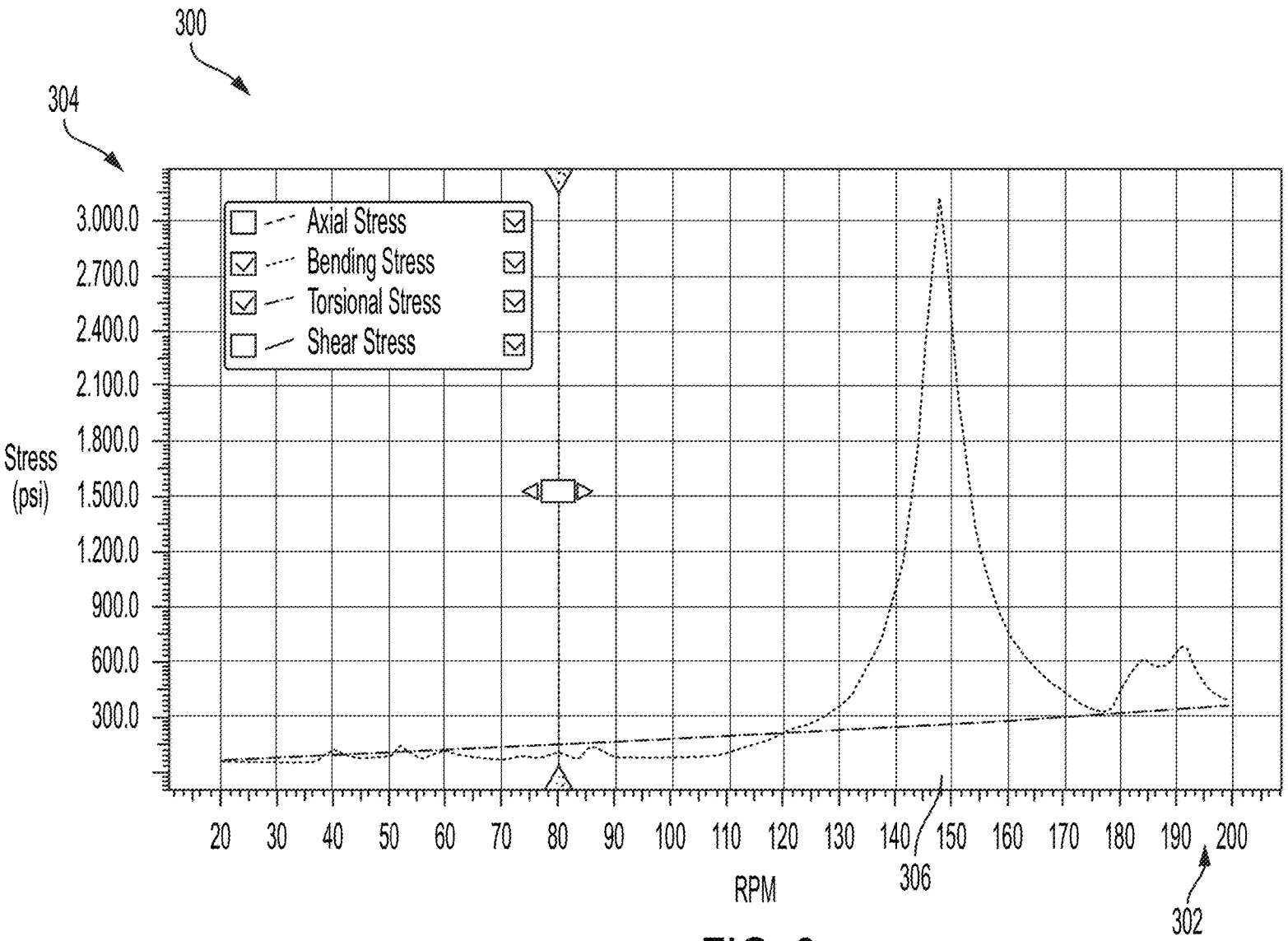
FIG. 3 is a graph of an example of a rotations-per-minute value that corresponds to a resonance speed according to one example of the present disclosure.

FIG. 3 is a graph 300 of an example of an RPM value that corresponds to a resonance speed 306 according to one example of the present disclosure. The graph 300 corresponds to a particular WOB value. An x-axis 302 of the graph 300 corresponds to RPMs, and a y-axis 304 of the graph 300 corresponds to stress. The resonance speed 306 is the RPM value at which the stress becomes significantly large, or peaks, for the WOB value. As illustrated in FIG. 3, the resonance speed 306 is one-hundred forty-eight RPMs for the particular WOB value. Thus, drilling equipment should not be operated at the particular WOB value and one-hundred forty-eight RPMs to avoid operating at the resonance speed 306.

Figure 4:
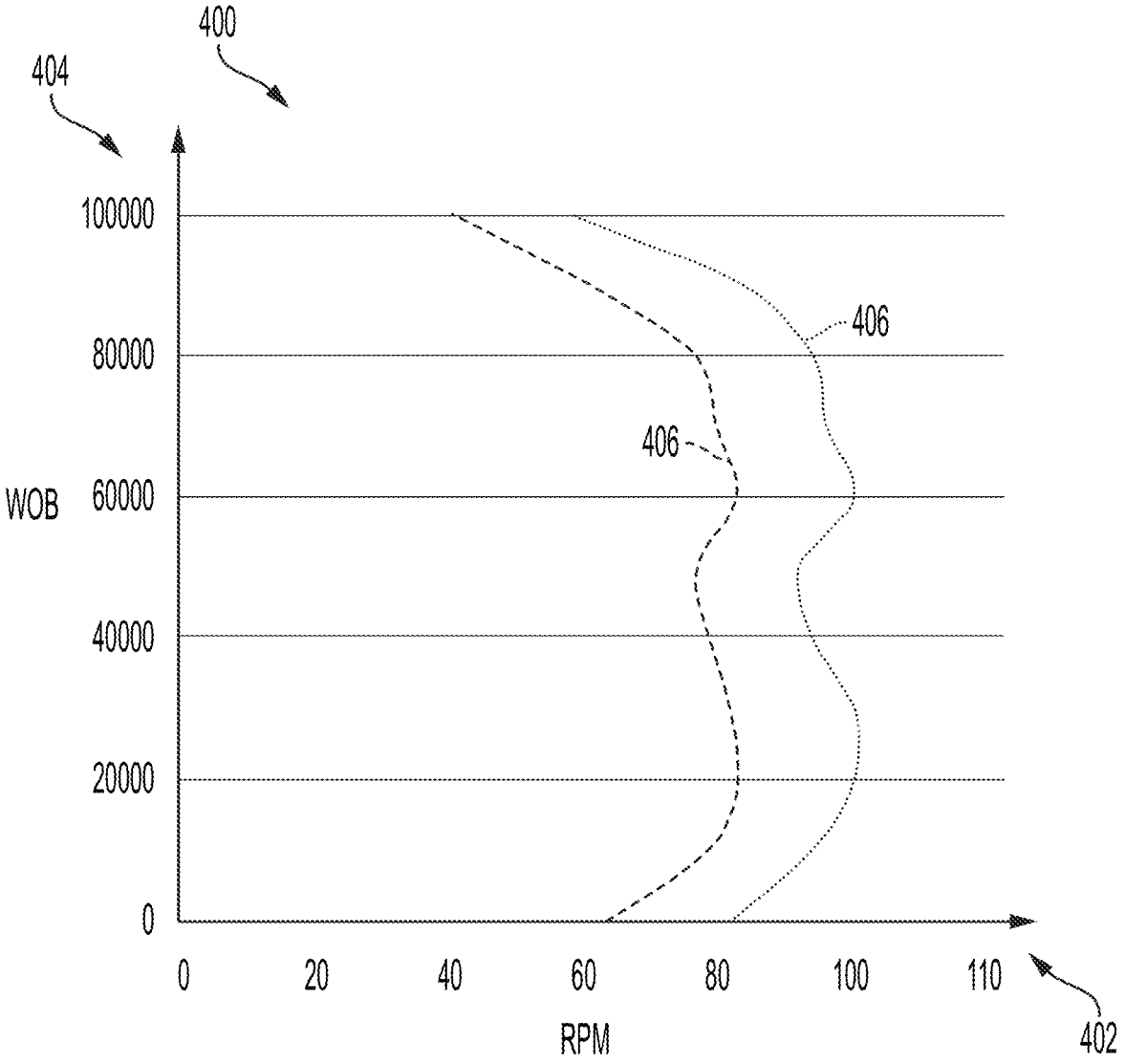
FIG. 4 is a graph of an example of a plot of weight-on-bit values and associated rotations-per-minute values that correspond to resonance speeds according to one example of the present disclosure.

FIG. 4 is a graph 400 of an example of a plot of WOB values and associated RPM values that correspond to resonance speeds according to one example of the present disclosure. The graph 400 corresponds to a particular drilling depth. An x-axis 402 of the graph 400 corresponds to RPMs, and a y-axis 404 of the graph 400 corresponds to WOB in pounds. Points of (RPM, WOB) on the graph 400 correspond to resonance speed points, or combinations of WOB values and RPM values that result in a resonance speed. The resonance speed points can be determined for a range of WOB values. As illustrated, RPM values that result in resonance speeds are determined for WOB values between zero and one-hundred thousand pounds. The resonance speed points can be connected to form curves 406 of values that are to be avoided during a drilling operation. For examples, the curves 406 indicate combinations of WOB values and RPM values that may result in forward whirl for the drilling equipment, so any points on the curves 406 should be avoided to improve a drilling operation.

Figure 5:
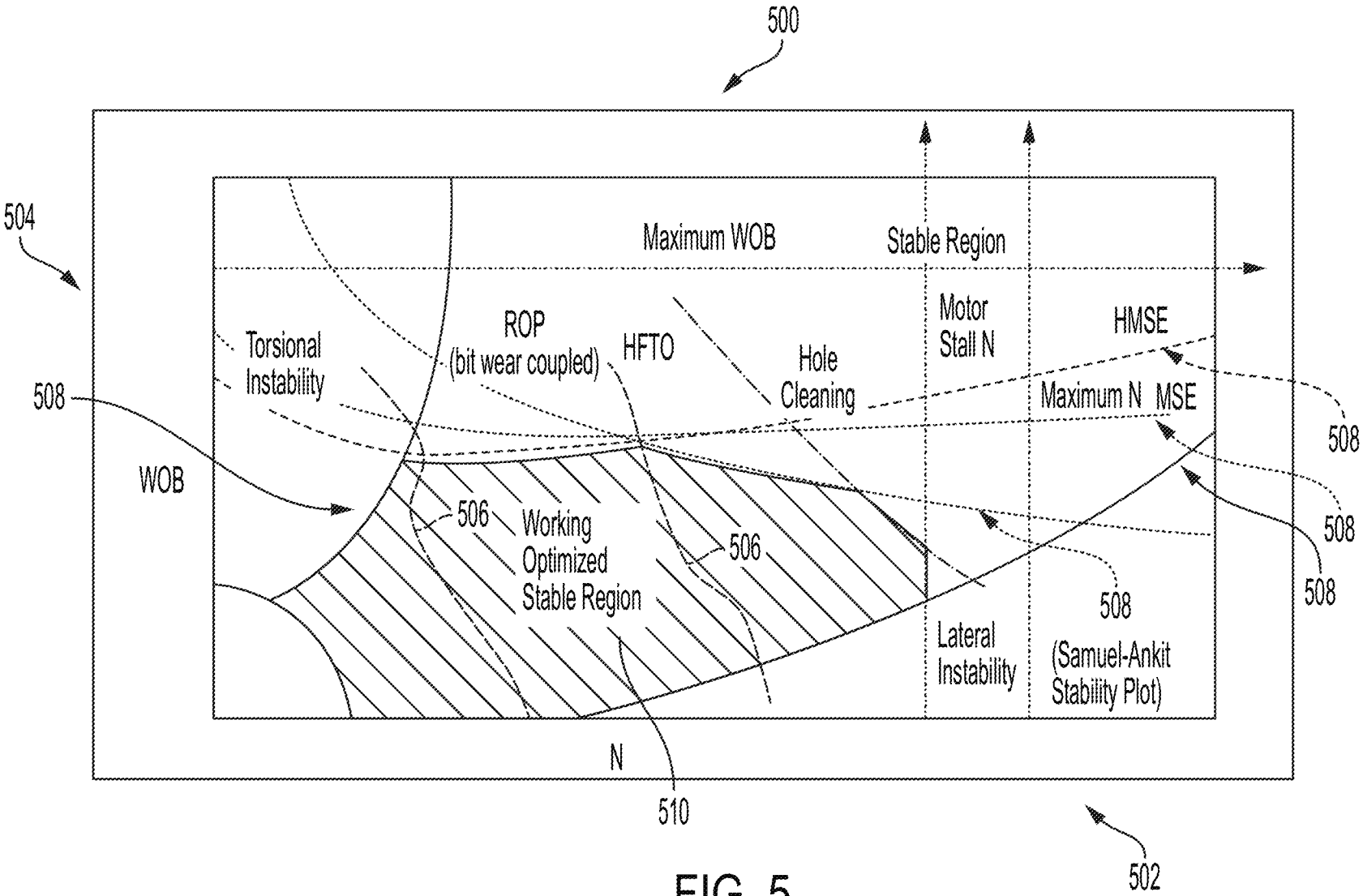
FIG. 5 is a graph of another example of a plot of weight-on-bit values and associated rotations-per-minute values that correspond to resonance speeds according to one example of the present disclosure.

FIG. 5 is a graph 500 of another example of a plot of WOB values and associated RPM values that correspond to resonance speeds according to one example of the present disclosure. The graph 500 corresponds to a particular drilling depth. An x-axis 502 of the graph 500 corresponds to RPMs, and a y-axis 504 of the graph 500 corresponds to WOBs in pounds. The graph 500 includes a stable region 510 determined based on dynamic-stability analysis. The stable region 510 corresponds to WOB values and RPM values for which a drilling operation can be stable. The stable region can be bounded by curves corresponding to torsional instability and lateral instability. Bounding the stable region can ensure that RPM values and WOB values that result in backward whirl or torsional stick-slip vibration are avoided during the drilling operation. Constraints 508 can be determined that further shrink a size of the stable region 510. For example, the constraints 508 are shown to include an HMSE curve, a MSE curve, and a bit-wear ROP curve.

Points of (RPM, WOB) on the graph 500 that make up curves 506 correspond to resonance speed points, or combinations of WOB values and RPM values that result in a resonance speed. The resonance speed points on the curves 506 can be combinations of WOB values and RPM values that are to be avoided during a drilling operation. For examples, the curves 506 indicate combinations of WOB values and RPM values that may result in forward whirl for the drilling equipment, so any points on the curves 506 should be avoided to improve a drilling operation.

Figure 6:
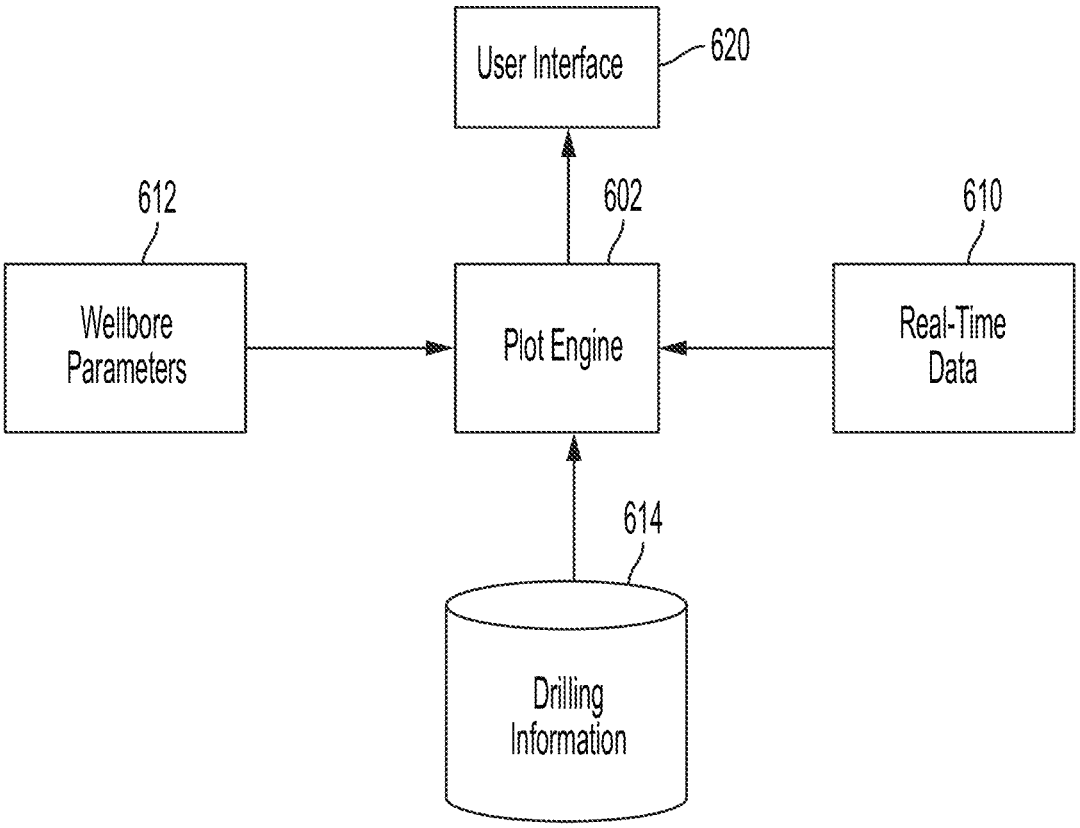
FIG. 6 is a block diagram of a system for determining parameters for a wellbore operation based on resonance speeds of drilling equipment according to one example of the present disclosure.

FIG. 6 is a block diagram of a system for determining parameters for a wellbore operation based on resonance speeds of drilling equipment according to one example of the present disclosure. A plot engine 602 can generate a plot that is usable in determining the drilling parameters. The plot engine 602 can receive real-time data 610 of a concurrently occurring drilling operation, wellbore parameters 612 for a wellbore associated with the drilling operation, and drilling information 614. The real-time data 610 may include the wellbore parameters 612, or the wellbore parameters 612 may be received separately from the real-time data 610. The real-time data 610 and the wellbore parameters 612 can include a wellbore inclination, drilling depth, standpipe pressure, mud flow in, rate of penetration, torque, equivalent circulation density, or any other drilling data. The drilling information 614 can store an indication of a previously drilling depth at which a chart was generated for WOB values and associated RPM values that correspond to resonance speeds. The plot engine 602 may generate plot at predefined intervals of drilling depths, such as every ninety feet, so the plot engine 602 can receive the drilling information 614 and determine whether the predefined interval has occurred since a plot has been generated. If so, the plot engine 602 can use the real-time data 610 and the wellbore parameters 612 to generate a plot for a current drilling depth.

The plot generated by the plot engine 602 can be similar to the graph 400 or the graph 500, in which one or more curves are generated of WOB values and associated RPM values that correspond to resonance speeds. The plot engine 602 can output the plot to a user interface 620. An operator may interact with the user interface 620 and use the plot to determine drilling parameters for the drilling operation. For example, the operator can select a combination of a WOB value and an RPM value for the current drilling depth that does not appear along the curve of values that correspond with resonance speeds. In some examples, the plot engine 602 may determine the drilling parameters from the plot and automatically send the drilling parameters to the drilling equipment for the drilling equipment to implement in the drilling operation.

Figure 7:
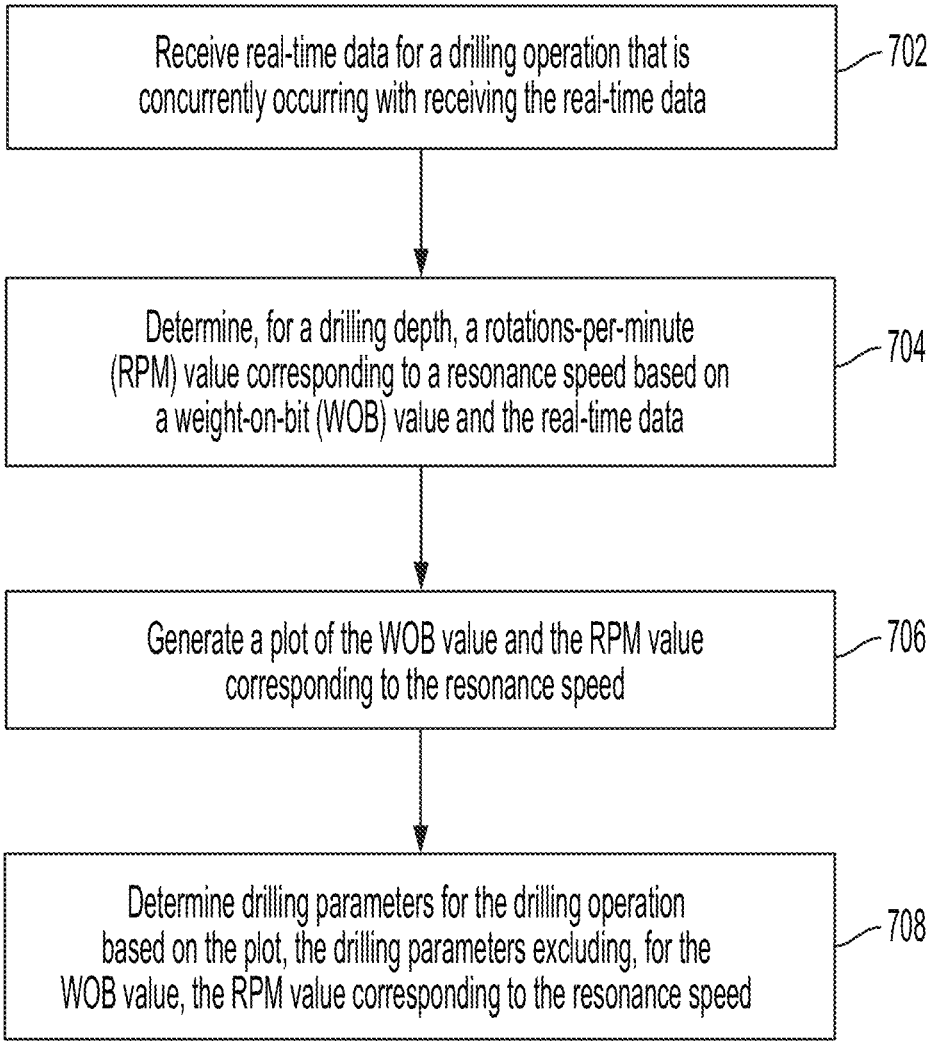
FIG. 7 is a flow chart of a process for determining parameters for a wellbore operation based on resonance speeds of drilling equipment according to one example of the present disclosure.

FIG. 7 is a flow chart of a process for determining parameters for a wellbore operation based on resonance speeds of drilling equipment according to one example of the present disclosure. In some examples, the computing device 200 in FIG. 2 can implement the process shown in FIG. 7 for effectuating some aspects of the present disclosure. Other examples can involve more operations, fewer operations, different operations, or a different order of the operations shown in FIG. 7. The operations of FIG. 7 are described below with reference to the components shown in FIG. 2.

At block 702, the computing device 200 can receive real-time data 210 for a drilling operation that is concurrently occurring with receiving the real-time data 210. A sensing component positioned downhole in a wellbore in communication with the computing device 200 can collect the real-time data 210 and send the real-time data 210 to the computing device 200. The real-time data 210 can include can include a wellbore inclination, drilling depth, standpipe pressure, mud flow in, rate of penetration, torque, equivalent circulation density, or any other drilling data.

At block 704, the computing device 200 can determine, for a drilling depth, a RPM value 212 corresponding to a resonance speed based on a WOB value and the real-time data 210. The drilling depth can be a current drilling depth indicated in the real-time data 210. The WOB value may be a current WOB value indicated in the real-time data 210, or may be any other WOB value the drilling equipment is capable of having. The computing device 200 can select the WOB value. The computing device 200 can determine, using the WOB value, at what RPM value a stress of the drilling system peaks, which can be the RPM value 212 that corresponds to the resonance speed. The computing device 200 may determine the RPM value 212 by generating a graph similar to the graph 300 in FIG. 3.

At block 706, the computing device 200 can generate a plot 214 of the WOB value and the RPM value 212 corresponding to the resonance speed. The plot 214 can be for the drilling depth and can include RPM values along an x-axis and WOB values along a y-axis. The WOB value and the RPM value 212 can be one resonance speed point on the plot 214. The plot 214 can also include other resonance speed points of WOB values and associated RPM values that correspond to resonance speeds. Each WOB value may be associated with one or more RPM values that correspond to resonance speeds. In some example, the computing device 200 can also perform dynamic-stability analysis to determine a stable region of operation for drilling parameters of the drilling operation bounded by a torsional instability curve and a lateral instability curve. The computing device 200 can include an indication of the stable region on the plot 214. Additionally, the stable region may be constrained based on an HMSE curve, a MSE curve, a bit-wear ROP curve, or a combination thereof.

At block 708, the computing device 200 can determine drilling parameters 216 for the drilling operation based on the plot 214. The drilling parameters 216 can exclude, for the WOB value, the RPM value 212 that corresponds to the resonance speed. The drilling parameters 216 can be selected from values within the stable region, but excluding combinations of WOB values and RPM values that are associated with a resonance speed. The computing device 200 may select an operating RPM value and an operating WOB value that are not associated with a resonance speed. For example, the computing device 200 may determine the operating WOB value to be the WOB value indicated in the real-time data 210, and can determine the operating RPM value to be any RPM value in the plot 214 that is not associated with a resonance speed for the operating WOB value. The computing device 200 may automatically cause the drilling parameters 216 to be used in the drilling operation by sending the drilling parameters 216 to the drilling equipment as control setpoints for the RPM and the WOB.

In some aspects, a system, a method, and a non-transitory computer readable medium for determining drilling parameters for a wellbore operation based on resonance speeds are provided according to one or more of the following examples:

As used below, any reference to a series of examples is to be understood as a reference to each of those examples disjunctively (e.g., "Examples 1-4" is to be understood as "Examples 1, 2, 3, or 4").

Example 1 is a system comprising: a processing device; and a memory device that includes instructions executable by the processing device for causing the processing device to: receive real-time data for a drilling operation that is concurrently occurring with receiving the real-time data; determine, for a drilling depth, a rotations-per-minute (RPM) value corresponding to a resonance speed based on a weight-on-bit (WOB) value and the real-time data; generate a plot of the WOB value and the RPM value corresponding to the resonance speed; and determine drilling parameters for the drilling operation based on the plot, the drilling parameters excluding, for the WOB value, the RPM value corresponding to the resonance speed.

Example 2 is the system of example 1, wherein the memory device further includes instructions executable by the processing device for causing the processing device to: adjust the drilling operation to include the drilling parameters.

Example 3 is the system of examples 1-2, wherein the memory device further includes instructions executable by the processing device for causing the processing device to: determine, for the drilling depth and a plurality of WOB values, a plurality of RPM values corresponding to a plurality of resonance speeds, each WOB value of the plurality of WOB values associated with a corresponding RPM value of the plurality of RPM values, the plurality of WOB values including the WOB value, the plurality of RPM values including the RPM value, and the plurality of resonance speeds including the resonance speed; generate the plot by plotting, for each WOB value of the plurality of WOB values, the corresponding RPM value of the plurality of RPM values; and determine the drilling parameters for the drilling operation based on the plot, the drilling parameters excluding, for each WOB value of the plurality of WOB values, the corresponding RPM value of the plurality of RPM values.

Example 4 is the system of example(s) 1-3, wherein the memory device further includes instructions executable by the processing device for causing the processing device to: determine a stable region for the drilling parameters of the drilling operation; and determine the drilling parameters based on the stable region, the WOB value, and the RPM value corresponding to the resonance speed.

Example 5 is the system of example 4, wherein the memory device further includes instructions executable by the processing device for causing the processing device to determine the stable region by: constraining the stable region based on a maximum mechanical specific energy curve, a maximum hydro-mechanical specific energy curve, a bit-wear rotations-per-minute curve, or a combination thereof.

Example 6 is the system of example(s) 1-5, wherein the memory device further includes instructions executable by the processing device for causing the processing device to: output the plot to a user interface, the plot usable by an operator to determine the drilling parameters.

Example 7 is the system of example(s) 1-6, wherein the memory device further includes instructions executable by the processing device for causing the processing device to: determine, for the WOB value at the drilling depth, an additional RPM value that corresponds to another resonance speed is an outlier resonance speed; and remove the additional RPM value for the WOB value from the plot.

Example 8 is the system of example(s) 1-7, wherein the drilling parameters comprise an operating RPM value and an operating WOB value and the real-time data comprises a wellbore inclination, the drilling depth, standpipe pressure, mud flow in, rate of penetration, torque, and equivalent circulation density.

Example 9 is a method comprising: receive real-time data for a drilling operation that is concurrently occurring with receiving the real-time data; determine, for a drilling depth, a rotations-per-minute (RPM) value corresponding to a resonance speed based on a weight-on-bit (WOB) value and the real-time data; generate a plot of the WOB value and the RPM value corresponding to the resonance speed; and determine drilling parameters for the drilling operation based on the plot, the drilling parameters excluding, for the WOB value, the RPM value corresponding to the resonance speed.

Example 10 is the method of example 9, further comprising: adjusting the drilling operation to include the drilling parameters.

Example 11 is the method of example(s) 9-10, further comprising: determining, for the drilling depth and a plurality of WOB values, a plurality of RPM values corresponding to a plurality of resonance speeds, each WOB value of the plurality of WOB values associated with a corresponding RPM value of the plurality of RPM values, the plurality of WOB values including the WOB value, the plurality of RPM values including the RPM value, and the plurality of resonance speeds including the resonance speed; generating the plot by plotting, for each WOB value of the plurality of WOB values, the corresponding RPM value of the plurality of RPM values; and determining the drilling parameters for the drilling operation based on the plot, the drilling parameters excluding, for each WOB value of the plurality of WOB values, the corresponding RPM value of the plurality of RPM values.

Example 12 is the method of example(s) 9-11, further comprising: determining a stable region for the drilling parameters of the drilling operation; and determining the drilling parameters based on the stable region, the WOB value, and the RPM value corresponding to the resonance speed.

Example 13 is the method of example 12, wherein determining the stable region comprises: constraining the stable region based on a maximum mechanical specific energy curve, a maximum hydro-mechanical specific energy curve, a bit-wear rotations-per-minute curve, or a combination thereof.

Example 14 is the method of example(s) 9-13, further comprising: outputting the plot to a user interface, the plot usable by an operator to determine the drilling parameters.

Example 15 is the method of example(s) 9-14, further comprising: determining, for the WOB value at the drilling depth, an additional RPM value that corresponds to another resonance speed is an outlier resonance speed; and removing the additional RPM value for the WOB value from the plot.

Example 16 is a non-transitory computer-readable medium comprising instructions that are executable by a processing device for causing the processing device to perform operations comprising: receiving real-time data for a drilling operation that is concurrently occurring with receiving the real-time data; determining, for a drilling depth, a rotations-per-minute (RPM) value corresponding to a resonance speed based on a weight-on-bit (WOB) value and the real-time data; generating a plot of the WOB value and the RPM value corresponding to the resonance speed; and determining drilling parameters for the drilling operation based on the plot, the drilling parameters excluding, for the WOB value, the RPM value corresponding to the resonance speed.

Example 17 is the non-transitory computer-readable medium of example 16, further comprising instructions executable by the processing device for causing the processing device to: adjust the drilling operation to include the drilling parameters.

Example 18 is the non-transitory computer-readable medium of example(s) 16-17, further comprising instructions executable by the processing device for causing the processing device to: determine, for the drilling depth and a plurality of WOB values, a plurality of RPM values corresponding to a plurality of resonance speeds, each WOB value of the plurality of WOB values associated with a corresponding RPM value of the plurality of RPM values, the plurality of WOB values including the WOB value, the plurality of RPM values including the RPM value, and the plurality of resonance speeds including the resonance speed; generate the plot by plotting, for each WOB value of the plurality of WOB values, the corresponding RPM value of the plurality of RPM values; and determine the drilling parameters for the drilling operation based on the plot, the drilling parameters excluding, for each WOB value of the plurality of WOB values, the corresponding RPM value of the plurality of RPM values.

Example 19 is the non-transitory computer-readable medium of example(s) 16-18, further comprising instructions executable by the processing device for causing the processing device to: determine a stable region for the drilling parameters of the drilling operation; and determine the drilling parameters based on the stable region, the WOB value, and the RPM value corresponding to the resonance speed.

Example 20 is the non-transitory computer-readable medium of example 19, further comprising instructions executable by the processing device for causing the processing device to determine the stable region by: constraining the stable region based on a maximum mechanical specific energy curve, a maximum hydro-mechanical specific energy curve, a bit-wear rotations-per-minute curve, or a combination thereof.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A system comprising:

a processing device; and a memory device that includes instructions executable by the processing device for causing the processing device to:

receive real-time data for a drilling operation that is concurrently occurring with receiving the real-time data;

determine, for a drilling depth, a rotations-per-minute (RPM) value corresponding to a resonance speed based on a weight-on-bit (WOB) value and the real-time data;

determine, for the drilling depth, a second RPM value corresponding to the resonance speed based on the WOB value and the real-time data;

generate a plot of the WOB value, the RPM value, and the second RPM value corresponding to the resonance speed;

remove a coordinate corresponding to the second RPM value from the plot based on the second RPM value being associated with a lower stress and a lower displacement than the RPM value;

determine drilling parameters for the drilling operation based on the plot, the drilling parameters excluding, for the WOB value, the RPM value corresponding to the resonance speed; and cause drilling equipment to implement the drilling parameters in the drilling operation by sending the drilling parameters to the drilling equipment as control setpoints.

2. The system of claim 1, wherein the memory device further includes instructions executable by the processing device for causing the processing device to cause the drilling equipment to implement the drilling parameters in the drilling operation by:

adjusting the drilling operation to include the drilling parameters to avoid resonance or vibration by selecting an operation parameter from the drilling parameters.

3. The system of claim 1, wherein the memory device further includes instructions executable by the processing device for causing the processing device to:

determine, for the drilling depth and a plurality of WOB values, a plurality of RPM values corresponding to a plurality of resonance speeds, each WOB value of the plurality of WOB values associated with a corresponding RPM value of the plurality of RPM values, the plurality of WOB values including the WOB value, the plurality of RPM values including the RPM value, and the plurality of resonance speeds including the resonance speed;

generate the plot by plotting, for each WOB value of the plurality of WOB values, the corresponding RPM value of the plurality of RPM values; and determine the drilling parameters for the drilling operation based on the plot, the drilling parameters excluding, for each WOB value of the plurality of WOB values, the corresponding RPM value of the plurality of RPM values.

4. The system of claim 1, wherein the memory device further includes instructions executable by the processing device for causing the processing device to:

determine a stable region bounded by a torsional instability curve and a lateral instability curve and at least a maximum mechanical specific energy curve for the drilling parameters of the drilling operation;

indicate the stable region in the plot, wherein the stable region corresponds to the drilling depth associated with a predefined interval of drilling depths; and determine the drilling parameters based on the stable region, the WOB value, and the RPM value corresponding to the resonance speed.

5. The system of claim 4, wherein the memory device further includes instructions executable by the processing device for causing the processing device to determine the stable region by:

constraining the stable region based on a maximum mechanical specific energy curve, a maximum hydro-mechanical specific energy curve, a bit-wear rotations-per-minute curve, or a combination thereof.

6. The system of claim 1, wherein the memory device further includes instructions executable by the processing device for causing the processing device to:

output the plot to a user interface, the plot usable by an operator to determine the drilling parameters.

7. The system of claim 1, wherein the memory device further includes instructions executable by the processing device for causing the processing device to:

determine, for the WOB value at the drilling depth, an additional RPM value that corresponds to another resonance speed is an outlier resonance speed; and remove the additional RPM value for the WOB value from the plot.

8. The system of claim 1, wherein the drilling parameters comprise an operating RPM value and an operating WOB value and the real-time data comprises a wellbore inclination, the drilling depth, standpipe pressure, mud flow in, rate of penetration, torque, and equivalent circulation density.

9. A method comprising:

receiving real-time data for a drilling operation that is concurrently occurring with receiving the real-time data;

determining, for a drilling depth, a rotations-per-minute (RPM) value corresponding to a resonance speed based on a weight-on-bit (WOB) value and the real-time data;

determining, for the drilling depth, a second RPM value corresponding to the resonance speed based on the WOB value and the real-time data;

generating a plot of the WOB value, the RPM value, and the second RPM value corresponding to the resonance speed;

removing a coordinate corresponding to the second RPM value from the plot based on the second RPM value being associated with a lower stress and a lower displacement than the RPM value;

determining drilling parameters for the drilling operation based on the plot, the drilling parameters excluding, for the WOB value, the RPM value corresponding to the resonance speed; and causing drilling equipment to implement the drilling parameters in the drilling operation by sending the drilling parameters to the drilling equipment as control setpoints.

10. The method of claim 9, further comprising wherein causing the drilling equipment to implement the drilling parameters in the drilling operation comprises: adjusting the drilling operation to include the drilling parameters to avoid resonance or vibration by selecting an operation parameter from the drilling parameters.

11. The method of claim 9, further comprising:

determining, for the drilling depth and a plurality of WOB values, a plurality of RPM values corresponding to a plurality of resonance speeds, each WOB value of the plurality of WOB values associated with a corresponding RPM value of the plurality of RPM values, the plurality of WOB values including the WOB value, the plurality of RPM values including the RPM value, and the plurality of resonance speeds including the resonance speed;

generating the plot by plotting, for each WOB value of the plurality of WOB values, the corresponding RPM value of the plurality of RPM values; and determining the drilling parameters for the drilling operation based on the plot, the drilling parameters excluding, for each WOB value of the plurality of WOB values, the corresponding RPM value of the plurality of RPM values.

12. The method of claim 9, further comprising:

determining a stable region bounded by a torsional instability curve and a lateral instability curve and at least a maximum mechanical specific energy curve for the drilling parameters of the drilling operation;

indicating the stable region in the plot, wherein the stable region corresponds to the drilling depth associated with a predefined interval of drilling depths; and determining the drilling parameters based on the stable region, the WOB value, and the RPM value corresponding to the resonance speed.

13. The method of claim 12, wherein determining the stable region comprises:

constraining the stable region based on a maximum mechanical specific energy curve, a maximum hydromechanical specific energy curve, a bit-wear rotations-per-minute curve, or a combination thereof.

14. The method of claim 9, further comprising:

outputting the plot to a user interface, the plot usable by an operator to determine the drilling parameters.

15. The method of claim 9, further comprising:

determining, for the WOB value at the drilling depth, an additional RPM value that corresponds to another resonance speed is an outlier resonance speed; and removing the additional RPM value for the WOB value from the plot.

16. A non-transitory computer-readable medium comprising instructions that are executable by a processing device for causing the processing device to perform operations comprising:

receiving real-time data for a drilling operation that is concurrently occurring with receiving the real-time data;

determining, for a drilling depth, a rotations-per-minute (RPM) value corresponding to a resonance speed based on a weight-on-bit (WOB) value and the real-time data;

determining, for the drilling depth, a second RPM value corresponding to the resonance speed based on the WOB value and the real-time data;

generating a plot of the WOB value, the RPM value, and the second RPM value corresponding to the resonance speed;

removing a coordinate corresponding to the second RPM value from the plot based on the second RPM value being associated with a lower stress and a lower displacement than the RPM value;

determining drilling parameters for the drilling operation based on the plot, the drilling parameters excluding, for the WOB value, the RPM value corresponding to the resonance speed; and causing drilling equipment to implement the drilling parameters in the drilling operation by sending the drilling parameters to the drilling equipment as control setpoints.

17. The non-transitory computer-readable medium of claim 16, further comprising instructions executable by the processing device for causing the processing device to cause the drilling equipment to implement the drilling parameters in the drilling operation by:

adjusting the drilling operation to include the drilling parameters to avoid resonance or vibration by selecting an operation parameter from the drilling parameters.

18. The non-transitory computer-readable medium of claim 16, further comprising instructions executable by the processing device for causing the processing device to:

determine, for the drilling depth and a plurality of WOB values, a plurality of RPM values corresponding to a plurality of resonance speeds, each WOB value of the plurality of WOB values associated with a corresponding RPM value of the plurality of RPM values, the plurality of WOB values including the WOB value, the plurality of RPM values including the RPM value, and the plurality of resonance speeds including the resonance speed;

generate the plot by plotting, for each WOB value of the plurality of WOB values, the corresponding RPM value of the plurality of RPM values; and determine the drilling parameters for the drilling operation based on the plot, the drilling parameters excluding, for each WOB value of the plurality of WOB values, the corresponding RPM value of the plurality of RPM values.

19. The non-transitory computer-readable medium of claim 16, further comprising instructions executable by the processing device for causing the processing device to:

determine a stable region bounded by a torsional instability curve and a lateral instability curve and at least a maximum mechanical specific energy curve for the drilling parameters of the drilling operation;

indicate the stable region in the plot, wherein the stable region corresponds to the drilling depth associated with a predefined interval of drilling depths; and determine the drilling parameters based on the stable region, the WOB value, and the RPM value corresponding to the resonance speed.

20. The non-transitory computer-readable medium of claim 19, further comprising instructions executable by the processing device for causing the processing device to determine the stable region by:

constraining the stable region based on a maximum mechanical specific energy curve, a maximum hydromechanical specific energy curve, a bit-wear rotations-per-minute curve, or a combination thereof.

* * * * *